US006530312B1

(12) United States Patent
Jakab

(10) Patent No.: US 6,530,312 B1
(45) Date of Patent: Mar. 11, 2003

(54) PRESS

(76) Inventor: Gabor Jakab, Oberer Garwiedenweg 8, D-88677 Markdorf (DE)

( * ) Notice: Subject to any disclaimer, the term of this patent is extended or adjusted under 35 U.S.C. 154(b) by 97 days.

(21) Appl. No.: 09/593,492

(22) Filed: Jun. 14, 2000

(30) Foreign Application Priority Data

Jun. 14, 1999 (DE) ..... 199 27 330

(51) Int. Cl.[7] ..... B30B 15/14

(52) U.S. Cl. ..... 100/49; 100/103; 100/131; 100/264; 100/902

(58) Field of Search ..... 100/48, 49, 231, 100/234, 246, 283, 289, 131, 902, 249, 264, 103

(56) References Cited

U.S. PATENT DOCUMENTS

| | | | | | |
|---|---|---|---|---|---|
| 3,916,780 | A | * | 11/1975 | Heiser | 100/216 |
| 4,203,225 | A | * | 5/1980 | Nilsson | 33/503 |
| 4,248,334 | A | * | 2/1981 | Hanley et al. | 100/902 |
| 4,265,170 | A | * | 5/1981 | Schulze, Jr. | 100/116 |
| 4,358,994 | A | * | 11/1982 | Talley | 100/137 |
| 4,429,626 | A | * | 2/1984 | Ihara et al. | 100/117 |
| 4,499,824 | A | * | 2/1985 | Elwing et al. | 100/104 |
| 4,526,096 | A | * | 7/1985 | La Barge et al. | 100/215 |
| 5,042,634 | A | * | 8/1991 | Gulmini | 100/902 |
| 5,067,398 | A | * | 11/1991 | Thoma | 100/256 |
| 5,094,157 | A | * | 3/1992 | Challis et al. | 100/137 |
| 5,103,721 | A | * | 4/1992 | Chou et al. | 100/131 |
| 5,111,927 | A | * | 5/1992 | Schulze, Jr. | 100/902 |
| 5,167,184 | A | * | 12/1992 | Rebecchi | 100/131 |
| 5,188,022 | A | * | 2/1993 | Benson et al. | 100/288 |
| 5,277,810 | A | * | 1/1994 | Shepard | 100/125 |
| 5,333,542 | A | * | 8/1994 | Lewis et al. | 100/266 |
| 5,379,689 | A | * | 1/1995 | Timmons et al. | 100/211 |
| 5,381,732 | A | * | 1/1995 | Trout | 100/215 |
| 5,483,870 | A | * | 1/1996 | Anderson et al. | 100/108 |
| 5,488,899 | A | * | 2/1996 | Jennings et al. | 100/102 |
| 5,520,105 | A | * | 5/1996 | Healy | 100/103 |
| 5,819,644 | A | * | 10/1998 | Coffelt | 100/216 |
| 6,055,902 | A | * | 5/2000 | Harrop et al. | 100/229 A |

FOREIGN PATENT DOCUMENTS

| | | |
|---|---|---|
| DE | 43 33 796 | 5/1994 |
| DE | 44 38 218 | 5/1995 |

* cited by examiner

*Primary Examiner*—Rinaldi I. Rada
*Assistant Examiner*—Louis Tran
(74) *Attorney, Agent, or Firm*—Crowell & Moring LLP

(57) ABSTRACT

A press has two pressure levers connected with pressure plates which can be moved against one another by a driving motor. A control device acts upon the driving motor and permits different sequences of movement of the pressure levers during the pressing operation according to different operating programs. An operating program is provided for crushing cans and containers and another operating program is provided for extracting juice. In order to avoid faulty operations, the pressure plates are constructed for receiving different mounts for the various operating modes. At least one pressure plate is connected with a sensor which detects the type of mount and reports it to the control device. Despite an expanded application range, the operating of the press is simple because, for starting both pressing operations, the equipment operator actuates only one starting switch, the selecting of the operating programs taking place automatically, which ensures a high safety standard.

16 Claims, 2 Drawing Sheets

PRESS

BACKGROUND AND SUMMARY OF INVENTION

This application claims the priority of German patent document 199 27 330.8 filed Jun. 15, 1999, the disclosure of which is expressly incorporated by reference herein.

The present invention relates to a press having a carrying structure for pressure levers carrying two pressure plates, which pressure levers can be moved against one another by way of a transmission and a driving motor.

A press of this type is known, for example, from German Patent Document DE 43 33 796 A1 or DE 44 38 218 A1. The presses described there are used as can or container presses, in one case, an electrohydraulic drive being used and, in the other case, an electromechanical drive being used. For starting the pressing operating, in which case two pressure plates fastened to pressure levers move synchronously against one another, a switch is actuated which is situated in an electric circuit with an electric motor. Limit and end switches are used for limiting the pressure lever movement and control the access to the operating range of the press by means of an access flap serving as a safety precaution device. After the termination of the press operation by means of an end switch or change-over switch, the pressure plates return into their starting position; the access flap is released; and the pressed-together container or the can be removed.

It is an object of the present invention to provide a press of the above-described type with an expanded application range whose operation remains simple and which has a high safety standard. The object is achieved by a press of the above-noted type, wherein the pressure plates are constructed for receiving different mounts for different pressing operations, and wherein a sensor is connected with at least one pressure plate, which sensor recognizes the type of mount and is connected with a control device for regulating the output of the driving motor, which control device activates different sequences of movement of the pressure levers. According to the invention, it is provided to construct the press for at least two different application areas, in which case the driving motor of the press can be controlled for different sequences of movement of the pressure levers by way of a control according to different programs. In order to avoid a faulty operation, in the case of different press operations, the pressure plates are provided with different mounts; thus, for example, with a mount for pressing cans or a mount for extracting juice mashing. A sensor, which is connected with at least one pressure plate, automatically detects the type of mount and releases a corresponding operating program. The sensor is preferably constructed with a mechanical operating member which can take up two switching positions. According to the construction of the surface of the mount facing the pressure plate, the actuating member is pressed down or, by means of a spring, remains in its position projecting over the surface of the pressure plate. The corresponding advantageous further developments are obtained from the subclaims.

BRIEF DESCRIPTION OF THE DRAWINGS

In the following, the invention will be explained again by means of the attached drawings.

DETAILED DESCRIPTION OF THE DRAWINGS

Figure 1:
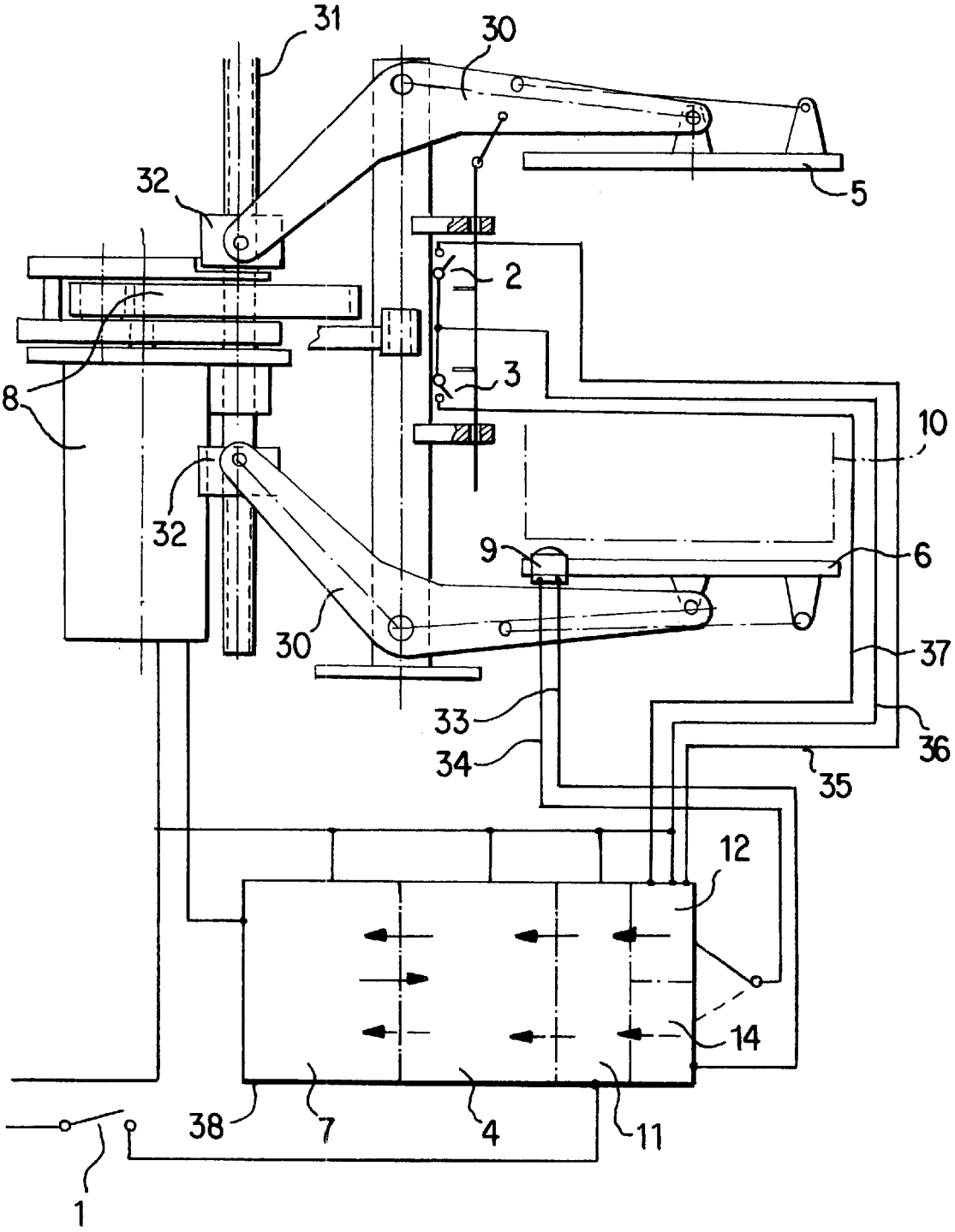
FIG. 1 is a lateral view of the essential press parts with a schematic view of the essential electrical components of the control.

FIG. 1 is a schematic view of a press with e lower and upper presser levers 30 which carry pressure plates 5 and 6 on their free ends. A driving motor 8, which is constructed as an electric motor, is coupled with a spindle 31 by a transmission, which spindle 31 can be caused to rotate by touching a starting key 1. The spindle 31, which is constructed on one half with a right-hand screw and on its other half with a left-hand screw, causes the pressure levers 30 fastened in an articulated manner on a supporting column to carry out a mutually opposed axial movement by way of threaded shoes 32 which run on the spindle 31. Additional details can be found in the earlier German Application DE 44 38 218 A1 indicated with respect to the prior art.

In a simplified manner, the control is illustrated in FIG. 1 as a control block having sections 4, 7, 11, 12 and 14. By way of control lines 33, 34, sections 12 and 14 are connected with a sensor 9 and, by way of control lines 35, 36, 37, they are connected with end switches 2 and 3. Section 11 contains a change-over control which, as the result of the input quantities received in sections 12 and 14, selects one of at least two control programs stored in section 4. The control program selected for a pressing operation controls an output regulator which is contained in section 7 and regulates the current for the driving motor 8.

Figure 2:
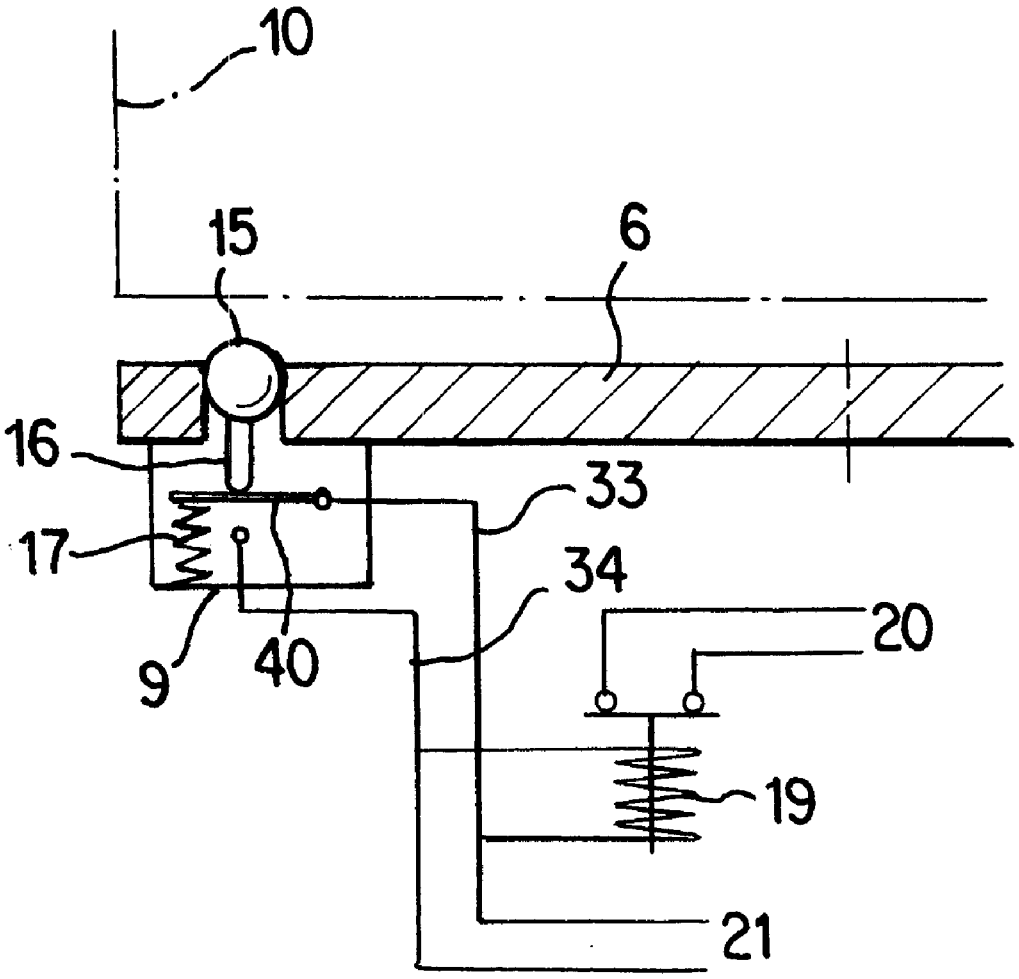
FIG. 2 is a fragmentary view of a pressure plate in the area of a sensor with connected control lines.

FIG. 2 illustrates a sensor 9, which is held on a lower pressure plate 6 and is constructed with a spherical actuating member 15, which is illustrated in a starting position projecting over the surface of the pressure plate. The spherical actuating member is connected with a slide 16 which, in turn, is supported on a rocker lever 40 of a microswitch 9. The rocker lever is held in the illustrated starting position by a spring 17. In the event that the spherical actuating member 15 is depressed by a mount 10 which rests on the pressure plate 6 and whose contour edge is outlined by a dash-dotted line, the rocker lever 40 connects two contacts of an electric circuit with the lines 33 and 34. As the result, a relay 19 is switched which interrupts a control circuit 20 while a change-over takes place to a control circuit 21. The relay 19 as well as the control circuits 20 and 21 are arranged in section 12, 14 of the control block. Control circuit 20 preferably activates the can pressing program. Control circuit 21 activates the juice extraction program.

Function: The illustrated apparatus therefore has two control programs for different pressing operations. One program is used for crushing cans or similar containers made of plastic or metal. This pressing operation takes place with a rapid continuous movement of the pressure levers 30. Another program, which provides a sequence of movements of the pressure levers 30 which, in comparison, is slow and possibly intermittent, is used for extracting juice or for mashing. Here, it is also provided that, a; the end of the pressing operation, the pressure levers remain in the end position for a defined time period, until the pressed liquid has run off. In this case, a juice extraction mount is situated between the pressure plates 5 and 6 which consists of a cylinder having a piston which can be displaced therein, which is not illustrated in the drawing. On its face, the cylinder has a mesh insert which, depending on the material to be pressed, is constructed with different hole widths. As the material to be pressed, soft fruit and berries can be used, such as citrus fruit and similar fruit whose juice is to be extracted. However, by means of an appropriate mesh insert, it is also possible to mash fruit, potatoes, tomatoes, zucchini, etc.

After the placing of the mount 10 suitable for the desired pressing operation, the switch 1 is operated for the start. The can pressing program or the Juice extraction program will then automatically take place which, by means of the sensor 9 interacting with the mount 10 is selected as described above by the electronic control system. The pressing operation is terminated by the end switch 3 which communicates with the control block. After the end position has been reached, the pressure plates 30 automatically return into the starting position, controlled by a program stored in the control block. In the event that, before the response of the end switches, a limit load is reached which is preadjusted in the output regulator, the driving motor is also stopped, and the electronic control system takes over the returning of the pressure plates into the starting position. This protects the apparatus against an overloading, so that damage is prevented, for example, by hard cores in the juice extraction mount or an overloading when pressing cans.

In this further development, the apparatus can therefore be operated in the simplest manner by only one starting switch, and, as the result of the automatic selection of the operating programs, a faulty operation by the operator of the apparatus is necessarily avoided.

What is claimed is:

1. Press having a carrying structure for pressure levers carrying two pressure plates, which pressure levers can be moved against one another by way of a transmission and a driving motor, wherein the pressure plates are constructed for receiving different mounts for different pressing operations, wherein a sensor is connected with at least one pressure plate, which sensor recognizes the type of mount and is connected with a control device for regulating an output of the driving motor, which control device activates one of a plurality of control programs for different sequences of movement of the pressure levers as a function of the mount recognized by the sensor, and wherein in a mounted condition, a surface of a mount facing the pressure plate does not come in contact with an actuating member of the sensor.

2. Press having a carrying structure for pressure levers carrying two pressure plates, which pressure levers can be moved against one another by way of a transmission and a driving motor, wherein the pressure plates are constructed for receiving different mounts for different pressing operations, wherein a sensor is connected with at least one pressure plate, which sensor recognizes the type of mount and is connected with a control device for regulating an output of the driving motor, which control device activates one of a plurality of control programs for different sequences of movement of the pressure levers as a function of the mount recognized by the sensor, and wherein in a mounted condition, a surface of a mount facing the pressure plate presses down an actuating member of the sensor.

3. Press having a carrying structure for pressure levers carrying two pressure plates, which pressure levers can be moved against one another by way of a transmission and a driving motor, wherein the pressure plates are constructed for receiving different mounts for different pressing operations, wherein a sensor is connected with at least one pressure plate, which sensor recognizes the type of mount and is connected with a control device for regulating an output of the driving motor, which control device activates one of a plurality of control programs for different sequences of movement of the pressure levers as a function of the mount recognized by the sensor, and wherein upon actuation of a starting key in a switching condition of the sensor, a continuous rapid sequence of movements of the pressure levers takes place during a pressing operation.

4. Press having a carrying structure for pressure levers carrying two pressure plates, which pressure levers can be moved against one another by way of a transmission and a driving motor, wherein the pressure plates are constructed for receiving different mounts for different pressing operations, wherein a sensor is connected with at least one pressure plate, which sensor recognizes the type of mount and is connected with a control device for regulating an output of the driving motor, which control device activates one of a plurality of control programs for different sequences of movement of the pressure levers as a function of the mount recognized by the sensor, and wherein upon actuation of a starting key in a switching condition of the sensor, a slow and intermittent sequence of movements of the pressure levers takes place during a pressing operation.

5. Press according to claim 4, wherein, at an end of the pressing operation, the pressure levers remain in an end position for a defined time period.

6. Press assembly, comprising:

a pair of pressure levers carrying respective pressure plates which face one another, a plurality of differently shaped mounts which are exchangeably attachable to at least one of the pressure plates, said differently shaped mounts being configured to facilitate respective different pressing operations, a drive unit including a drive motor and a transmission operable to control movement of the levers and pressure plates to perform pressing operations, a sensor operable to distinguish which of said mounts is present, and a control unit operable to control the drive unit to perform different pressing operations as a function of the mount sensed by the sensor, wherein a first of said mounts is configured for performing a can crushing pressing operation and a second of said mounts is configured for performing a juice extracting pressing operation.

7. Press assembly according to claim 6, wherein said control device is operable to control the drive unit to perform a can crushing operation with a rapid sequence of movements of the pressure levers when the first mount is present and sensed by the sensor.

8. Press assembly according to claim 6, wherein said control device is operable to control the drive unit to perform a juice extracting operation with at least one of slow and intermittent movements of the pressure levers when the second mount is detected.

9. Press assembly according to claim 7, wherein said control device is operable to control the drive unit to perform a juice extracting operation with at least one of slow and intermittent movements of the pressure levers when the second mount is detected.

10. Press having a carrying structure for pressure levers carrying two pressure plates, which pressure levers can be moved against one another by way of a transmission and a driving motor, wherein the pressure plates are constructed for receiving different mounts for different pressing operations, wherein a sensor is connected with at least one pressure plate, which sensor recognizes the type of mount and is connected with a control device for regulating an output of the driving motor, which control device activates one of a plurality of control programs for different sequences of movement of the pressure levers as a function of the mount recognized by the sensor, and wherein upon actuation of a starting key in a switching condition of the sensor, a slow sequence of movements of the pressure levers takes place during a pressing operation.

11. Press having a carrying structure for pressure levers carrying two pressure plates, which pressure levers can be moved against one another by way of a transmission and a driving motor, wherein the pressure plates are constructed for receiving different mounts for different pressing operations, wherein a sensor is connected with at least one pressure plate, which sensor recognizes the type of mount and is connected with a control device for regulating an output of the driving motor, which control device activates one of a plurality of control programs for different sequences of movement of the pressure levers as a function of the mount recognized by the sensor, and wherein upon actuation of a starting key in a switching condition of the sensor, an intermittent sequence of movements of the pressure levers takes place during a pressing operation.

12. Press having a carrying structure for pressure levers carrying two pressure plates, which pressure levers can be moved against one another by way of a transmission and a driving motor, wherein the pressure plates are constructed for receiving different mounts for different pressing operations, and wherein a sensor is connected with at least one pressure plate, which sensor recognizes the type of mount and is connected with a control device for regulating an output of the driving motor, which control device activates different sequences of movement of the pressure levers; and wherein in a mounted condition, a surface of a mount facing the pressure plate does not come in contact with an actuating member of the sensor.

13. Press having a carrying structure for pressure levers carrying two pressure plates, which pressure levers can be moved against one another by way of a transmission and a driving motor, wherein the pressure plates are constructed for receiving different mounts for different pressing operations, and wherein a sensor is connected with at least one pressure plate, which sensor recognizes the type of mount and is connected with a control device for regulating an output of the driving motor, which control device activates different sequences of movement of the pressure levers; and wherein in a mounted condition, a surface of a mount facing the pressure plate presses down an actuating member of the sensor.

14. Press having a carrying structure for pressure levers carrying two pressure plates, which pressure levers can be moved against one another by way of a transmission and a driving motor, wherein the pressure plates are constructed for receiving different mounts for different pressing operations, and wherein a sensor is connected with at least one pressure plate, which sensor recognizes the type of mount and is connected with a control device for regulating an output of the driving motor, which control device activates different sequences of movement of the pressure levers; and wherein upon actuation of a starting key in a switching condition of the sensor, a continuous rapid sequence of movements of the pressure levers takes place during a pressing operation.

15. Press having a carrying structure for pressure levers carrying two pressure plates, which pressure levers can be moved against one another by way of a transmission and a driving motor, wherein the pressure plates are constructed for receiving different mounts for different pressing operations, and wherein a sensor is connected with at least one pressure plate, which sensor recognizes the type of mount and is connected with a control device for regulating an output of the driving motor, which control device activates different sequences of movement of the pressure levers; and wherein upon actuation of a starting key in a switching condition of the sensor, at least one of a slow and intermittent sequence of movements of the pressure levers takes place during a pressing operation.

16. Press according to claim 15, wherein, at an end of the pressing operation, the pressure levers remain in an end position for a defined time period.

* * * * *